US012753669B1

(12) United States Patent
Nafa et al.

(10) Patent No.: US 12,753,669 B1
(45) Date of Patent: Oct. 6, 2026

(54) RECOVERABLE FISHING TOOL

(71) Applicant: SAUDI ARABIAN OIL COMPANY, Dhahran (SA)

(72) Inventors: Hamed Nafa, Dammam (SA); Ali Abdulwahed Al Qassab, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/318,573

(22) Filed: Sep. 4, 2025

(51) Int. Cl.
*E21B 31/12* (2006.01)
*E21B 31/20* (2006.01)

(52) U.S. Cl.
CPC ..... *E21B 31/125* (2013.01); *E21B 31/20* (2013.01)

(58) Field of Classification Search
CPC ... E21B 31/00; E21B 31/12–20; A01K 85/00; A01K 85/02–029
See application file for complete search history.

(56) References Cited

U.S. PATENT DOCUMENTS 111,146 A * 1/1871 Peters ..... E21B 31/20 294/86.24
621,380 A * 3/1899 Shoffner ..... E21B 31/20 294/86.24
776,425 A * 11/1904 Riggs ..... E21B 31/20 294/86.24
1,445,581 A * 2/1923 Fullop ..... E21B 31/20 294/86.2
1,540,566 A * 6/1925 Petree ..... E21B 31/20 294/86.17
2,158,814 A * 5/1939 Ashcraft ..... E21B 31/20 294/86.25
4,353,585 A * 10/1982 Carver ..... E21B 31/125 294/86.2

(Continued)

FOREIGN PATENT DOCUMENTS

CN 215169864 U * 12/2021
CN 114961621 A * 8/2022 ..... E21B 31/12

(Continued)

OTHER PUBLICATIONS

Schlumberger, "fishing", undated, https://glossary.slb.com/en/terms/f/fishing, 1 page (Year: 2026).*

(Continued)

*Primary Examiner* — Jennifer H Gay
(74) *Attorney, Agent, or Firm* — Osha Bergman Watanabe & Burton LLP

(57) ABSTRACT

A fishing method and tool include a fishing tool having retractable spikes positioned radially around a tool body, a pivotable connection connecting each of the retractable spikes to the tool body, and a severable connection securing each of the retractable spikes to the tool body in the extended position. In an extended position, the retractable spikes extend outwardly from the tool body. In a retracted position, the retractable spikes are retracted inwardly in relation to the tool body. The severable connection includes a shear pin pinned in a first port of each of the retractable spikes. When the shear pin of a connected retractable spike is broken, the connected retractable spike moves into the retracted position.

18 Claims, 4 Drawing Sheets

(56) References Cited

U.S. PATENT DOCUMENTS

| | | | | | |
|---|---|---|---|---|---|
| 4,397,494 | A * | 8/1983 | Carver | E21B 31/125 294/86.2 |
| 4,537,435 | A * | 8/1985 | Carver | E21B 31/125 294/86.2 |
| 11,555,369 | B2 * | 1/2023 | Al-Shehri | E21B 31/20 |
| 12,473,790 | B2 * | 11/2025 | Billingham | E21B 47/002 |
| 2022/0268120 | A1 * | 8/2022 | Al-Shehri | E21B 31/12 |
| 2024/0368955 | A1 * | 11/2024 | Billingham | E21B 47/09 |

FOREIGN PATENT DOCUMENTS

| | | | | | |
|---|---|---|---|---|---|
| CN | 114961622 | A | * | 8/2022 | E21B 31/20 |
| CN | 115478804 | A | * | 12/2022 | E21B 31/20 |
| SU | 926234 | A1 | | 5/1982 | |

OTHER PUBLICATIONS

"Combination Wire Finder Grab," LiMAR, Retrieved Sep. 4, 2025 from URL <https://www.limaroiltools.com/wireline/fishing/adjustable-wire-finder-grab> (8 pages).

* cited by examiner

RECOVERABLE FISHING TOOL

BACKGROUND

In the oil and gas industry, hydrocarbon fluids are commonly found in hydrocarbon reservoirs. These hydrocarbon reservoirs are located far below the surface of the earth in porous rock formations. In order to access the hydrocarbon fluids, wells are drilled into the formations. Furthermore, a number of electrical systems may be deployed within a wellbore of the well to perform various operations. In conventional methods, power is provided to the electrical systems or downhole tools from external sources at the surface via cables.

For example, an electrical cable, or a wireline, may be employed to provide power to submerged process control equipment, pumps and compressors, transformers, motors, and other electrically operated equipment downhole in the wellbore. Commonly, a wireline is formed of braided cables and may also be used to transmit data about the conditions of the wellbore to the surface. In addition to a wireline or alternative to a wireline, a slickline may be run in the wellbore. A slickline is a nonelectric cable utilized to set and retrieve wellbore tools, such as a plug.

In the course of drilling and completing boreholes to produce oil and gas from subterranean reservoirs, or while stimulating and producing hydrocarbons from subterranean reservoirs, it is not uncommon for equipment to be dropped, lost, or lodged into the borehole from the surface or for downhole tools and equipment to become separated from their conveyor. When this occurs, it is frequently necessary to retrieve the dropped equipment or separated downhole tools from the borehole before normal drilling, completing, stimulating, or producing operations may continue. This process of retrieval is commonly called "fishing" and the equipment or tools to be retrieved are commonly called "fish." Typically, regular drill bits cannot drill through fish. One of the most challenging fishing jobs is the recovery of a tool or instrument run with a wireline or slickline when the wireline or slickline has been cut and is lost downhole.

An example of a fish is a wireline that is lost downhole and, in that case, any downhole tool that may still be connected to the wireline. Hooking the wireline may result in retrieving the downhole tool as well. Lost wireline is challenging to grapple, grip, or hook using traditional fishing tools and may result in wire getting tangled and stuck downhole with the fishing tools. When the wireline tangles with the fishing tool, there is higher risk of having another object lost downhole.

Accordingly, there exists a need for a borehole fishing tool that can recover the wireline and prevent tangling with the wire in the wellbore.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a fishing tool including retractable spikes positioned radially around a tool body, a pivotable connection connecting each of the retractable spikes to the tool body, and a severable connection securing each of the retractable spikes to the tool body in the extended position. In an extended position, the retractable spikes extend outwardly from the tool body. In a retracted position, the retractable spikes are retracted inwardly in relation to the tool body. The severable connection may include a shear pin pinned in a first port of each of the retractable spikes. When the shear pin of a connected retractable spike is broken, the connected retractable spike moves into the retracted position.

In one aspect, embodiments disclosed herein relate to a fishing method including inserting a fishing tool into a well, via a conveyor. The fishing tool includes retractable spikes positioned radially on a tool body held in an extended position by shear pins each pinned through a first port in each of the retractable spikes. The method further includes engaging a first retractable spike connected to a first shear pin with a line in the well, applying an upward jarring impact, in relation to the line in the well, to the fishing tool to break the first shear pin, and upon breaking of the first shear pin, moving the first retractable spike via a pivotable connection inwardly from the extended position to a retracted position adjacent the tool body. The line may be released from the fishing tool by moving the first retractable spike into the retracted position.

Other aspects and advantages of the claimed subject matter will be apparent from the following description and the appended claims.

BRIEF DESCRIPTION OF DRAWINGS

Specific embodiments of the disclosure will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of this disclosure relate to a borehole fishing tool that recovers a wireline fish and prevents tangling of the wire in a wellbore. The borehole fishing tool employs retractable spikes that pull back into the borehole fishing tool when stuck with wire to free the borehole fishing tool from the wire for retrieval back to surface.

Figure 1:
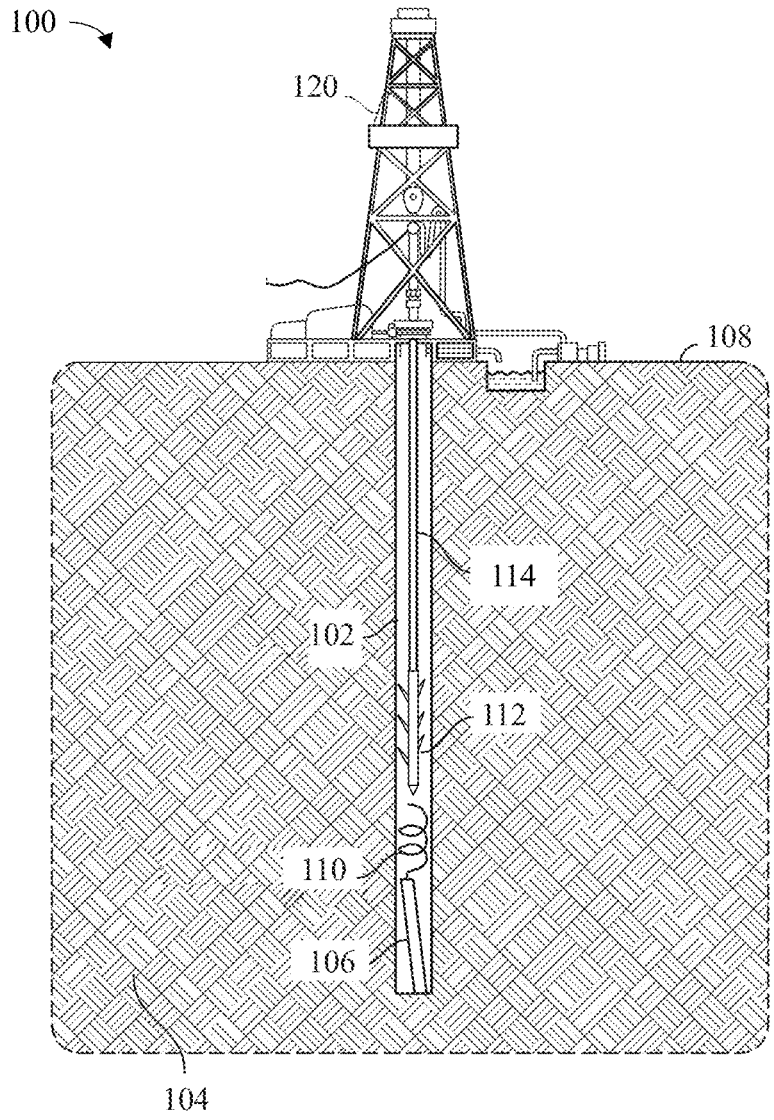
FIG. 1 shows a system in accordance with one or more embodiments.

FIG. 1 shows a schematic diagram in accordance with one or more embodiments. FIG. 1 illustrates a well environment (100) that includes a borehole (102), which may penetrate a subterranean region (104). The borehole (102) may contain a fish (e.g., fish 106). The fish may be a piece of equipment, a downhole tool, or a piece of completion, such as a portion of casing or tubing. The fish (106) may have been accidentally dropped into the borehole from the surface of the earth, e.g., surface (108). The fish (106) may have become accidentally separated from a conveyor of the fish. The fish (106) may have become stuck in the borehole (102) and been deliberately separated from the conveyor. The fish may be the conveyor itself, such as lost wireline, e.g., a wireline (110), or include the wireline (110). The lost wireline (110) may still be connected to a lost wireline tool (e.g., fish (106)) and fishing out the lost wireline (110) may also fish out the lost wireline tool or fish (106).

FIG. 1 further illustrates, in accordance with one or more embodiments, a borehole fishing tool, e.g., fishing tool (112), deployed within the borehole (102). The fishing tool (112) may be attached to a first end of a conveyor (114). The conveyor (114) may extend from the fishing tool (112) to the surface (108). A second end of the conveyor (114) may be attached to a means of suspension at the surface. The means of suspension may be, for example, a rig (120), a coiled tubing unit (not illustrated), or a crane and winch (not shown).

The conveyor (114) of the fishing tool (112) shown in FIG. 1 may, in accordance with one or more embodiments, be capable of inserting the fishing tool (112) into the borehole (102) and conveying and retrieving the fishing tool (112) from at least a portion of the borehole (102). The conveyor (114) may be selected from a group consisting of a slickline, a wireline, a coil tubing, a wired coil tubing, a drill string of drill pipe, or a wired drill string of wired drill pipe. Other options for the conveyor are contemplated and would be acceptable for use in other embodiments.

In accordance with one or more embodiments the conveyor (114) may be the drill string and the first end of the conveyor may be a connection to a drill pipe. The conveyor (114) may be connected to the fishing tool (112) with a connector (not shown) or via a top sub (e.g., top sub 204 shown in FIGS. 2-3). The connector may be an API standard tool joint as specified in ISO 11961:2018, and ISO 10424-2:2007 published by the International Organization for Standardization, or API Spec 7-2 published by the American Petroleum Institute.

In other embodiments, the fishing tool (112) may connect directly to the conveyor (114). Further, the conveyor (114) of the fishing tool (112) may be capable of lowering the fishing tool (112) into a substantially vertical borehole, e.g., borehole (102), and may be capable of pushing the fishing tool (112) into a highly deviated borehole and/or a horizontal borehole. The fishing tool (112) may be equipped with a spear, in accordance with one or more embodiments. The fishing tool (112), as further described in detail in FIGS. 2 and 3, may be capable of fixedly attaching to the fish (106) in such a manner as to connect the fishing tool (112) to the fish (106).

Figure 2:
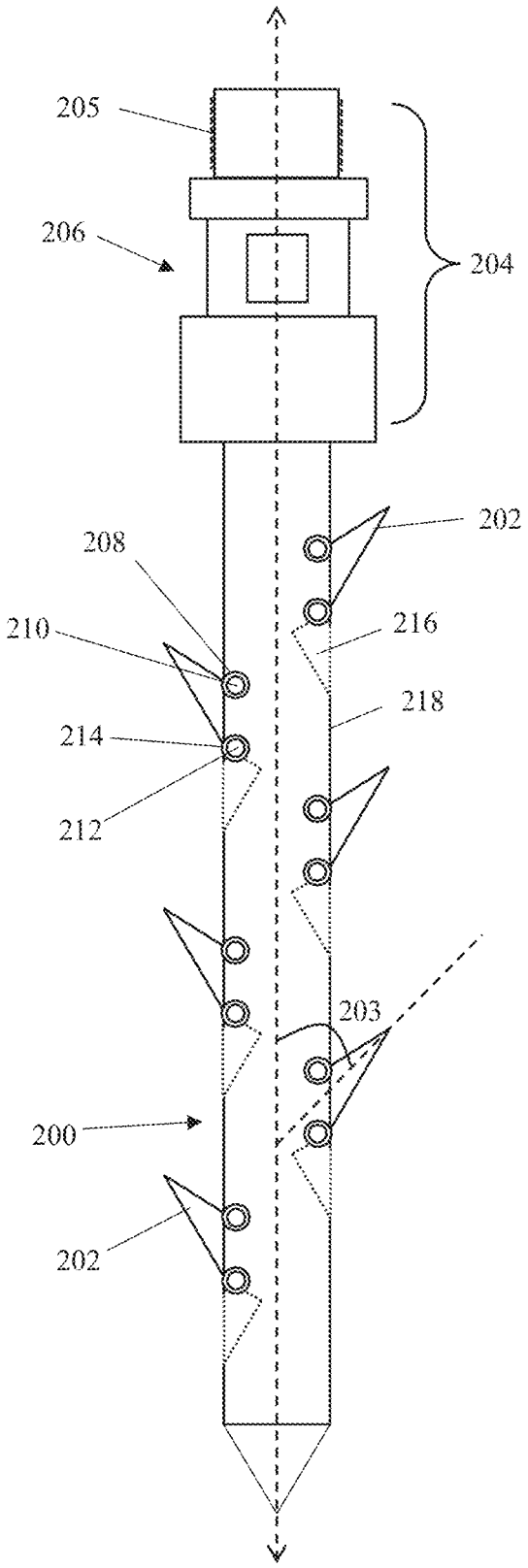
FIG. 2 shows a borehole fishing tool in an extended position used in conjunction with FIG. 1 in accordance with one or more embodiments.

FIG. 2 shows a borehole fishing tool used in conjunction with FIG. 1 in accordance with one or more embodiments. Specifically, FIG. 2 shows a tool body (200) of the fishing tool (112) shown and described in FIG. 1 in an extended position or rested state. The fishing tool (112) is designed to catch and return a lost wire (e.g., wireline (110)) to the surface (108). The tool body (200) includes retractable spikes (202) positioned radially around the tool body (200). The retractable spikes (202) may be fixed in the tool body (200). The retractable spikes (202) may be heavy duty spikes capable of penetrating, gripping, and retrieving metallic debris, such as wireline (110), cables or broken tubulars. For example, the retractable spikes (202) may be made up of a hardened alloy steel material or carbide-tipped material. Further, the retractable spikes (202) may be mounted to the tool body (200) via a mounting assembly and sized to have a thickness that are capable of withstanding high loads, abrasion, and impact under downhole conditions (e.g., using components of a mounting assembly having a selected shear strength and using retractable spikes (202) having a thickness ranging from about ¼ to ¾ of the tool body (200) diameter).

The retractable spikes (202) may be selectively installed and removed dependent on required designs. For example, the retractable spikes (202) may be of different sizes. In such instances, at least two of the retractable spikes (202) are a different size to each other.

The tool body (200) may be spear or tubular shaped and may be formed of a durable material, such as steel. The tool body (200) of the fishing tool (112) may be lowered and raised within the borehole (102) by a conveyor (e.g., conveyor (114)) or a wireline unit.

The conveyor (114) may be connected to the tool body (200) using a top sub (204) provided at a connection end of the tool body (200). The top sub (204) may be connected to or integral with the connection end of the tool body (200). In one or more embodiments, the top sub (204) may include a fish neck (206), which may be a section of reduced diameter that may be used for other fishing or retrieval tools to grip onto. Additionally, in one or more embodiments, the top sub (204) may include a connection (205), which may be connected to a first end of the conveyor (114). For example, in some embodiments, the conveyor (114) may be a pipe string connected to a threaded connection of the top sub (204). In some embodiments, the conveyor (114) may include a cable attached at one end to the tool body (200) via the top sub (204) and at the other end to a positioning device at the surface (108). The positioning device may be a cable unit or another device commonly known in the art for raising and lowering wireline tools within the borehole (102), such as the conveyor (114). Further, the cable may be a multi-conductor wire, a single conductor wire, a braided wire, or a fiber optic cable.

Figure 3:
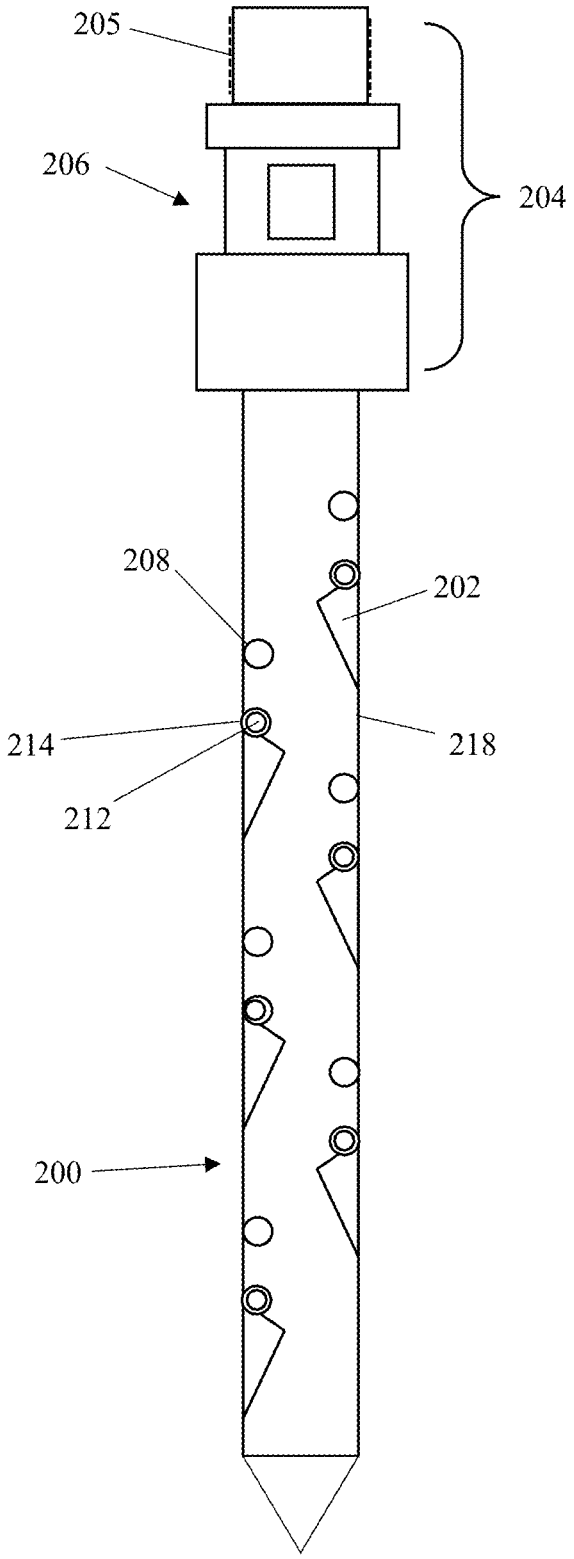
FIG. 3 shows a borehole fishing tool in a retracted position used in conjunction with FIG. 1 in accordance with one or more embodiments.

Retractable spikes (202) may be mounted to and removable from the tool body (200) via a mounting assembly. Further, the retractable spikes (202) may be movable relative to the tool body (200) between an extended position (extending outwardly from the tool body) and a retracted position (retracted at least partially into the tool body), e.g., as shown in FIGS. 2 and 3, respectively. In the extended position, the retractable spikes (202) may be angled at an acute angle 203 relative to a central axis of the tool body (200) and toward the connection end of the tool body (200) to maximize engagement during rotation or upward movement of the fishing tool. Mounting assemblies used to movably and removably connect retractable spikes (202) to the tool body (200) may include a severable connection (e.g., shear pin connections, latch connections, etc.) and a pivotable connection provided on an opposite side of the retractable spike from the severable connection. Examples of suitable severable and pivotable connections are described below with FIGS. 2 and 3.

In one or more embodiments, the retractable spikes (202) on the tool body (200) grab parts of the lost wireline (110) and recover it back to surface (108). The lost wireline (110) may be located in production tubing. For example, the tool body (200) is lowered into a well (e.g., in borehole (102) and/or through well tubing) until it reaches the approximate depth of a fish or lost wire (e.g., lost wireline (110)). In the extended position shown in FIG. 2, the retractable spikes (202) extend outwardly from the tool body (200). Each retractable spike (202) is connected to the tool body via a severable connection, including a first port (208) designed to receive a shear pin (210) to secure each of the retractable spikes (202) in the extended position to the tool body (200). The shear pin (210) may be any pin made of a material designed to break cleanly under a specific load, such as brass or mild steel. In some instances, the shear pin (210) is made of a low-alloy steel selected to have a shear strength that is less than the strength of the tool's conveyor (e.g., a deployment wire or cable), e.g., a shear strength ranging between 70% and 85% of the strength of the conveyor.

Additionally, each retractable spike (202) is connected to the tool body (200) via a pivotable connection on an opposite side of the retractable spike from the severable connection. In the embodiment shown, the severable connections are provided on an upper side of each retractable spike (relatively closer to the connection end), and the pivotable connections are provided on a lower side of each retractable spike (relatively farther from the connection end). The pivotable connection may include a hinge and/or swivel (212) mounted to the retractable spike and the tool body. For example, the swivel (212) may include a carbon steel pin pinned in a second port (214) of each of the retractable spikes (202).

Each of the first port (208) and the second port (214) may be any recess, connected eye, or precision-machined hole in the tool body (200) designed to receive and retain shear pins, alignment pins, or locking pins. Each port may be aligned with a corresponding port (e.g., recess, connected eye, or precision-machined hole) in the retractable spike (202) to ensure accurate pin engagement with both the tool body and retractable spike. The first port (208) and the second port (214) may be cylindrical in shape or slightly chamfered at the opening to guide a pin during assembly. The shear pin (210) may be a sacrificial component held in the first port (208), whereas the swivel (212) may be permanently secured (e.g., press-fit or welded) in the second port (214) and/or have a greater shear strength than the shear pin (210).

Once the fishing tool is positioned in a selected position in the well to retrieve a lost wireline (110), the tool body (200) may be slowly rotated, twisted, and/or slightly lowered/lifted (using conveying equipment at the surface), causing the retractable spikes (202) in the extended position to grip the lost wireline (110) and/or hook or embed into the lost wireline (110). The gripped lost wireline (110) wraps around and between the retractable spikes (202) of the tool body (200) to ensure a firm hold.

In some embodiments, once the wireline (110) is captured and wrapped around the retractable spikes (202), the fishing tool (112) is carefully pulled upward, allowing retrieval of the wireline from the borehole (102). The tool body (200) may include cavities (216), represented by the dashes lines in FIG. 2, where each cavity (216) may receive and at least partially fit each retractable spike (202). The cavities (216) may be positioned adjacent to each swivel (212), such that when a retractable spike is retracted, the retractable spike may be at least partially received within the adjacent cavity (216). In some embodiments, the cavities (216) may be sized and shaped, such that the connected retractable spikes (202) can entirely fit within each cavity (216) when retracted to be flush with an outer wall (218) of the tool body (200).

FIG. 3 shows the tool body (200) of FIG. 2 in a retracted position in accordance with one or more embodiments. Specifically, FIG. 3 shows the tool body (200) of the fishing tool (112), shown and described in FIGS. 1 and 2, in a retracted position or engaged state. In the retracted position, one or more of the retractable spikes (202) of the tool body (200) are retracted inwardly in relation to the tool body (200). FIG. 3 shows a retracted position in which all of the retractable spikes (202) are retracted; however, less than all of the retractable spikes (202), e.g., one or more, may be retracted in the retracted position. A person of ordinary skill in the art will appreciate that when a fishing tool is tangled in a parted nest of wire downhole, an operator may want to free the fishing tool from the wire. To engage the retracted position of the tool body (200), a severable connection to one or more of the retractable spikes (202) may be severed to allow the partially disconnected retractable spike(s) to retract into the tool body. For example, in the embodiment shown in FIG. 3, the shear pin (210) connected to each retractable spike (202) may be broken causing the connected retractable spikes (202) to move inwardly into the cavities (216). The retractable spikes (202) may swing or fall back in a downward position once the shear pin (210) is broken, where the swivel (212) may be engaged to allow rotation of the retractable spike relative to the tool body. In such instances, the swivel (212) may act as a pivot or hinge point.

As described in FIG. 2, the fishing tool may catch or grip the lost wireline (110) by wrapping the wireline around the retractable spikes (202). To prevent tangling of the wire, the tool body (200) may engage into a retracted position, as shown in FIG. 3, by applying a jarring action, force, mechanism, or impact onto the fishing tool (112) to break the severable connection to the tangled retractable spike(s) (e.g., by breaking the shear pin(s) (210) in FIG. 2). The jarring action may have an upward jarring impact. For example, the jarring action may be caused by pulling the fishing tool (112) uphole or back when stuck with a wire. The shear pin (210) breaks upon application of the jarring action, and the retractable spikes (202) retract inwardly into the tool body (200) using the swivel (212) to free the wireline (110). As illustrated in FIG. 3, the shear pins (210) of FIG. 2 are broken in the retracted position and are not depicted in FIG. 3.

In some embodiments, the tool body (200) is smooth in the retracted position because the retractable spikes (202) retract flush into the cavities (216) of the tool body (200). In the retracted position, the cavities (216) that were dashed and outlined in FIG. 2 are then illustrated as solid in FIG. 3 to show the retractable spikes (202) within the cavities (216). In some embodiments, one or more of the retractable spikes (202) in the retracted position reduce the tool body (200) perimeter and convert the tool body (200) to a smooth pipe. In the retracted position, the fishing tool (112) may slip out of a tangled nest of wireline (110) and then be safely retrieved back to surface (108). The tool body (200) may be redressed upon retrieval with new retractable spikes.

In some embodiments, the tool body (200) may include various sizes of retractable spikes and different shear pins for each retractable spike (202), such that some of the retractable spikes (202) may be engaged into the retracted position using different impact mechanisms (e.g., different jarring forces). In such instances, not all the retractable spikes (202) may be retracted at the same time.

Figure 4:
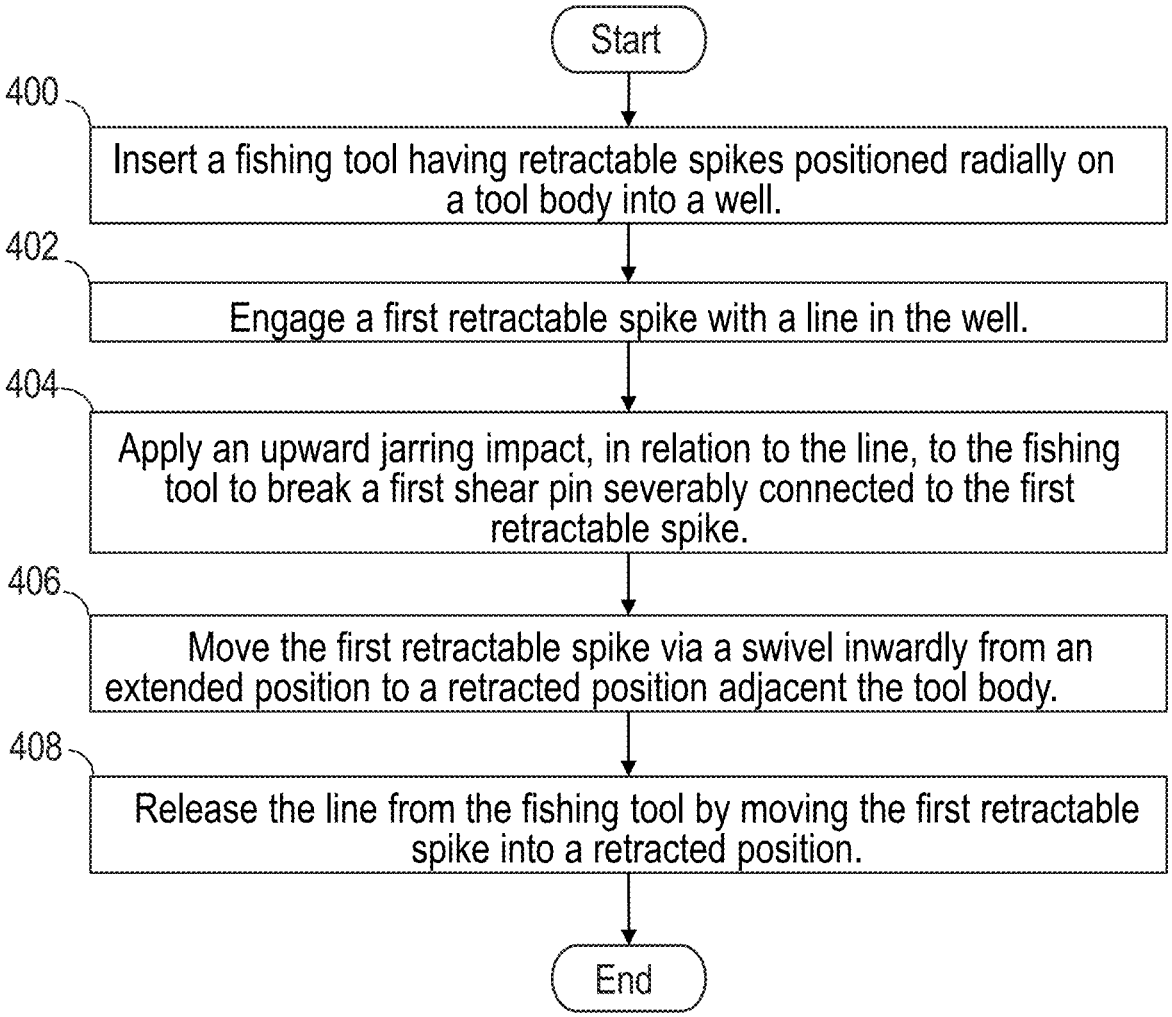
FIG. 4 shows a flowchart in accordance with one or more embodiments.

FIG. 4 shows a flowchart in accordance with one or more embodiments. Specifically, FIG. 4 describes a general well fishing method for a fishing tool (e.g., fishing tool (112)). One or more blocks in FIG. 4 may be performed by one or more components (e.g., fishing tool (112)) as described in FIGS. 1-3. While various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 400, a fishing tool having retractable spikes positioned radially on a tool body is inserted into a well. The fishing tool may be inserted into the well using a conveyor. When inserted, the retractable spikes may be held in an extended position by shear pins. Each shear pin may be pinned through an upper or first port in each of the retractable spikes. The conveyor may be selected from a group consisting of a slickline, a wireline, a coil tubing, a wired coil tubing, a string of drill pipe, and a string of wired drill pipe.

In Block 402, a first retractable spike is engaged with a line in the well. The first retractable spike is connected to the fishing tool body via a first shear pin of the shear pins. In Block 404, an upward jarring impact is applied, in relation to the line in the well, to the fishing tool to break the first shear pin. In Block 406, the first retractable spike is moved inwardly from an extended position to a retracted position adjacent the tool body via a swivel. The swivel may include a carbon steel pin pinned in a second port of each of the retractable spikes.

In Block 408, the line is released from the fishing tool by moving the first retractable spike into a retracted position. In some embodiments, the conveyor is retracted from the well to raise the fishing tool out of the well. Once raised from the well, the tool body may be redressed with new retractable spikes and new shear pins. One or more retractable spikes may be removed from the tool body (e.g., broken spikes may be removed). One or more new retractable spikes may be inserted into the tool body.

In one or more embodiments, additional retractable spikes on the tool body may be engaged with the line in the well, such that applying the upward jarring impact breaks the shear pin for each of the additional retractable spikes to move the spikes to the retracted position.

In one or more embodiments, a retrieval tool may be used to grip a fish neck (e.g., fish neck (206) in FIGS. 2-3) provided on the tool body or on a top sub connected to the tool body. For example, in some cases, a fishing tool (e.g., fishing tool (112) in FIG. 1) may be lost or disconnected during a fishing operation. In such instances, a separate retrieval tool may be sent downhole to pull or retrieve the fishing tool. By providing fishing tools according to embodiments of the present disclosure with a fish neck at its connection end, the fishing tool may be more easily retrieved when lost or disconnected using a separate retrieval tool.

Embodiments disclosed herein provide the following advantages. The fishing tool is an independent tool with quick installation and swapping of spikes. The tool as described herein eliminates the need for multiple tools required for multiple runs in the case where the fishing tool is stuck. This improves functionality and efficiency in downhole fishing scenarios and guarantees quick fishing tool recovery. Embodiments disclosed herein may specifically be used in situations with a stuck wire nest in a wellhead tree.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A fishing tool comprising:

retractable spikes positioned radially around a tool body, wherein in an extended position, the retractable spikes extend outwardly from the tool body, wherein in a retracted position, the retractable spikes are retracted inwardly in relation to the tool body;

a pivotable connection connecting each of the retractable spikes to the tool body;

a severable connection securing each of the retractable spikes to the tool body in the extended position, the severable connection comprising a shear pin pinned in a first port of each of the retractable spikes;

wherein when the shear pin of a connected retractable spike is broken, the connected retractable spike moves into the retracted position.

2. The fishing tool of claim 1, wherein the pivotable connection is at a first side of each of the retractable spikes, and wherein the severable connection is at a second side of each of the retractable spikes, opposite the first side.

3. The fishing tool of claim 1, wherein the pivotable connection comprises a pin pinned in a second port of each of the retractable spikes.

4. The fishing tool of claim 3, wherein the pin has a shear strength greater than the shear pin.

5. The fishing tool of claim 1, wherein the retractable spikes are removable.

6. The fishing tool of claim 1, wherein at least two of the retractable spikes have a different size.

7. The fishing tool of claim 1, further comprising a top sub provided at a connection end of the tool body.

8. The fishing tool of claim 7, wherein the top sub comprises a fish neck and a threaded connection.

9. The fishing tool of claim 1, further comprising a conveyor connected to a connection end of the fishing tool, wherein the conveyor is selected from a group consisting of a slickline, a wireline, a coil tubing, a wired coil tubing, a string of drill pipe, and a string of wired drill pipe.

10. The fishing tool of claim 1, wherein the tool body comprises receiving cavities positioned adjacent to each pivotable connection, wherein the receiving cavities are shaped to receive the connected retractable spike when the connected retractable spike is in the retracted position.

11. A method comprising:

inserting a fishing tool into a well, via a conveyor, the fishing tool having retractable spikes positioned radially on a tool body, wherein the retractable spikes are held in an extended position by shear pins, each shear pin being pinned through a first port in each of the retractable spikes;

engaging a first retractable spike of the retractable spikes with a line in the well, the first retractable spike connected to a first shear pin of the shear pins;

applying an upward jarring impact, in relation to the line in the well, to the fishing tool to break the first shear pin;

upon breaking of the first shear pin, moving the first retractable spike via a pivotable connection inwardly from the extended position to a retracted position adjacent the tool body; and releasing the line from the fishing tool by moving the first retractable spike into the retracted position.

12. The method of claim 11, further comprising:

retracting the conveyor from the well; and raising the fishing tool out of the well.

13. The method of claim 12, further comprising:

redressing the tool body with new retractable spikes and new shear pins once the fishing tool is raised out of the well.

14. The method of claim 12, further comprising:

removing the retractable spikes from the tool body.

15. The method of claim 11, wherein the pivotable connection comprises a pin pinned in a second port of each of the retractable spikes, the pin having a shear strength greater than the shear pin.

16. The method of claim 11, further comprising:

gripping, via a retrieval tool, a fish neck provided on the fishing tool.

17. The method of claim 11, wherein the conveyor is selected from a group consisting of a slickline, a wireline, a coil tubing, a wired coil tubing, a string of drill pipe, and a string of wired drill pipe.

18. The method of claim 11, further comprising engaging additional retractable spikes of the retractable spikes with the line in the well, wherein applying the upward jarring impact breaks the shear pin for each of the additional retractable spikes to move the additional retractable spikes to the retracted position.

* * * * *